US007347724B2

(12) United States Patent
Crupi

(10) Patent No.: US 7,347,724 B2
(45) Date of Patent: Mar. 25, 2008

(54) ELECTRICAL MULTIPLE RECEPTACLE OUTLET

(76) Inventor: Theodore P Crupi, 235 Gervil St., Staten Island, NY (US) 10309

( * ) Notice: Subject to any disclaimer, the term of this patent is extended or adjusted under 35 U.S.C. 154(b) by 0 days.

(21) Appl. No.: 11/303,793

(22) Filed: Dec. 15, 2005

(65) Prior Publication Data

US 2006/0178054 A1 Aug. 10, 2006

Related U.S. Application Data

(60) Provisional application No. 60/636,803, filed on Dec. 16, 2004.

(51) Int. Cl.
*H01R 13/60* (2006.01)

(52) U.S. Cl. ..... 439/535; 439/536; 439/650; 439/652; 174/66; 174/67

(58) Field of Classification Search ..... 439/535, 439/536, 650, 652, 106; 174/66, 67; D13/139.8
See application file for complete search history.

(56) References Cited

U.S. PATENT DOCUMENTS 2,618,677 A * 11/1952 Parish et al. ..... 439/650
3,327,277 A * 6/1967 Ramsing ..... 439/107
4,240,686 A 12/1980 Kurbikoff
4,504,103 A * 3/1985 Woedl ..... 439/131
4,978,318 A * 12/1990 Wiley et al. ..... 439/536
5,601,455 A * 2/1997 Bagga ..... 439/650
5,967,815 A * 10/1999 Schlessinger et al. ..... 439/188
6,113,434 A * 9/2000 Pate ..... 439/652
6,483,028 B2 * 11/2002 DeBartolo et al. ..... 174/483
D467,875 S 12/2002 Barger et al.
6,955,559 B2 * 10/2005 Pyrros ..... 439/535
2004/0052039 A1 3/2004 Oddsen et al.
2004/0201940 A1 10/2004 Fournier et al.

OTHER PUBLICATIONS

"Premium Grade Collection of Lighting Controls, Switches, Receptacles, Voice and Data and Wallplates" (Product Specification), Acenti by Leviton Manufacturing Co., Inc., 2004.

* cited by examiner

*Primary Examiner*—Tho D. Ta
(74) *Attorney, Agent, or Firm*—Ostrolenk, Faber, Gerb & Soffen, LLP

(57) ABSTRACT

An electrical outlet for mounting in an electrical box has a plurality of receptacles in a housing for receiving a plurality of electrical plugs, wherein each receptacle includes two electrical line openings and a ground opening, wherein the plurality of receptacles are positioned such that the ground opening of each of the plurality of receptacles is positioned outwardly with respect to the electrical line openings. The arrangement allows at least two transformer/adaptors to be plugged into the outlet simultaneously without interference.

13 Claims, 6 Drawing Sheets

Front View

Front View

Side View

Front View

Side View

ELECTRICAL MULTIPLE RECEPTACLE OUTLET

CROSS-REFERENCE TO RELATED APPLICATION

The present application claims the benefit and priority of U.S. Provisional Application No. 60/636,803 filed Dec. 16, 2004 and entitled ELECTRICAL MULTIPLE RECEPTACLE OUTLET, the entire disclosure of which is incorporated by reference herein.

BACKGROUND

1. Field of the Invention

The present invention relates to electrical outlets, in particular, to multiple receptacle electrical outlets, and more particularly, such outlets which have a plurality of electrical receptacles and preferably which fit, at least in part, into a standard electrical wall box. Further, an aim of the present invention is to allow a plurality of electrical voltage transformers/adaptors to be plugged into the outlet simultaneously without interference.

2. Related Art

A problem with standard dual receptacle wall outlets is that often two transformer/adaptors cannot be plugged into the two receptacles at the same time because the bodies of the transformers/adaptors interfere with each other. FIGS. 6B and 7B show examples of such standard duplex receptacle outlets.

Thus, it is desirable to provide an electrical outlet that avoids these problems. Further, it is desirable to provide such an outlet that has a plurality of two or more receptacles.

SUMMARY

An electrical outlet according to the present application fits into a standard electrical junction or wall box and includes a plurality of receptacles for receiving a plurality of electrical plugs, wherein each receptacle includes two electrical line openings, e.g., a hot opening and a neutral opening and further has a ground opening, wherein the plurality of receptacles are positioned such that the ground opening of each of the plurality of receptacles is positioned outwardly, adjacent to an edge of the electrical outlet, with respect to the electrical line openings. In one embodiment, a dual receptacle is provided. Another embodiment provides a triplex receptacle. Still others provide for more than three receptacles.

DRAWINGS

The invention will now be described in greater detail in the following detailed description with reference to the drawings, in which.

Figure 1A:
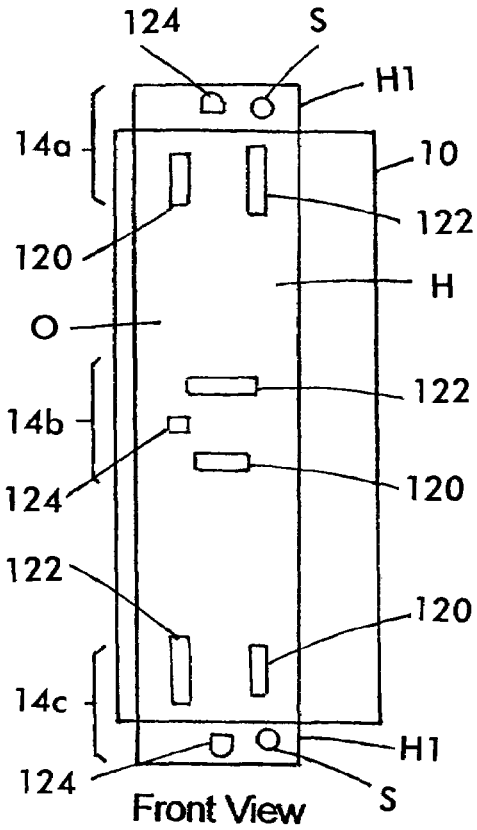
FIGS. 1A and 1B illustrate an electrical outlet in accordance with one embodiment of the present invention.
Figure 1B:
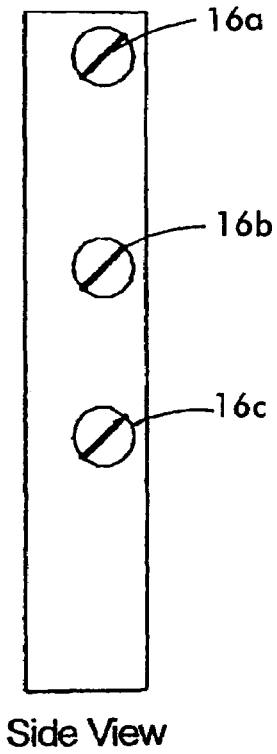
Figure 6A:
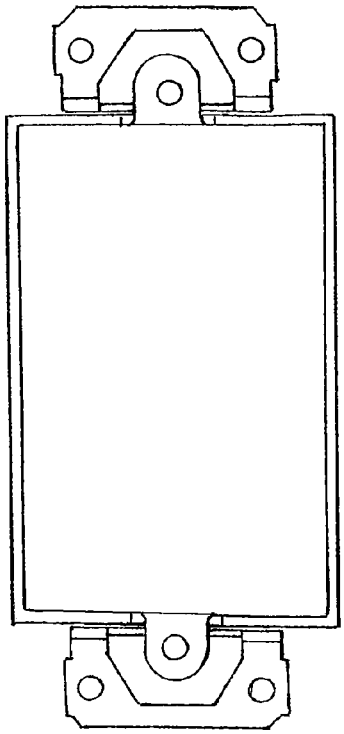
Fig 6A shows a standard single gang electrical box.
Figure 6A:
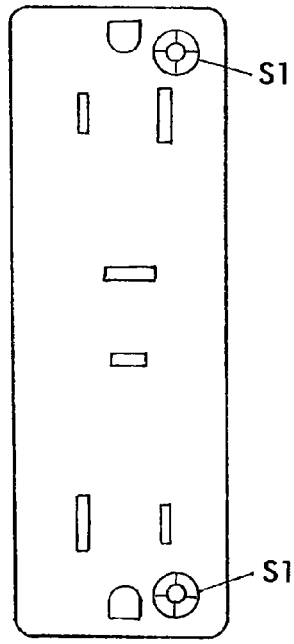

FIG. 6AA illustrates an electrical outlet in accordance with FIG. 1 for use with the single gang electrical box of FIG. 6A.

Figure 6B:
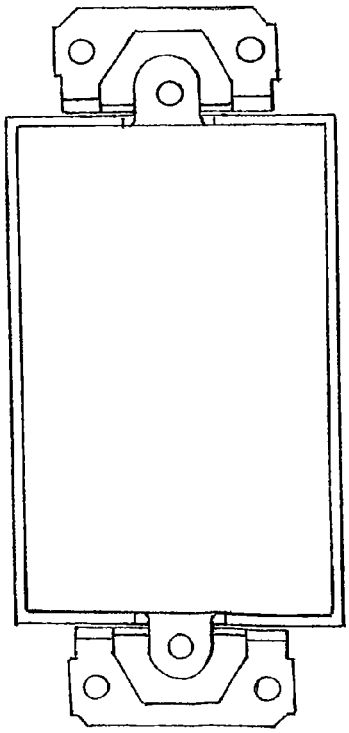
Figure 6B:
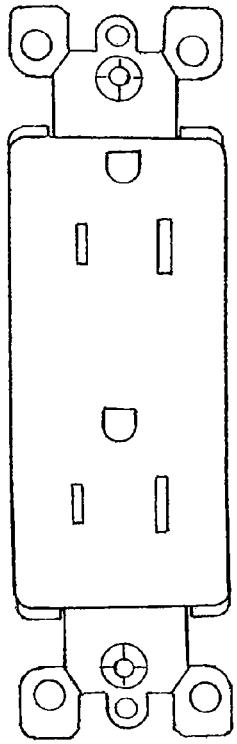
FIG. 6BB Prior Art

FIG. 6B shows a standard single gang electrical box;

FIG. 6BB illustrates a conventional electrical outlet for use with the single gang electrical boc of FIG. 6B.

Figure 7A:
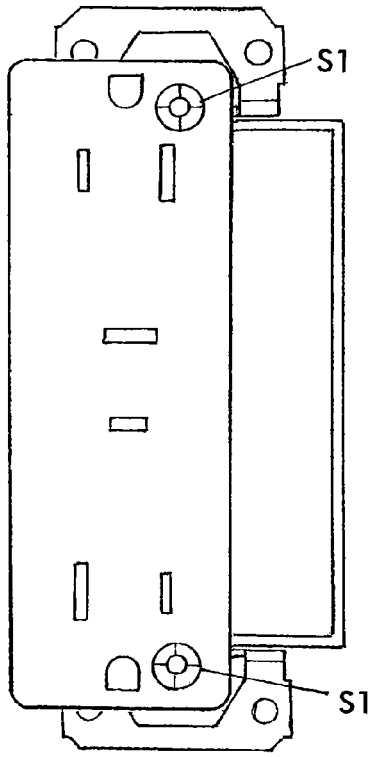
Figure 7B:
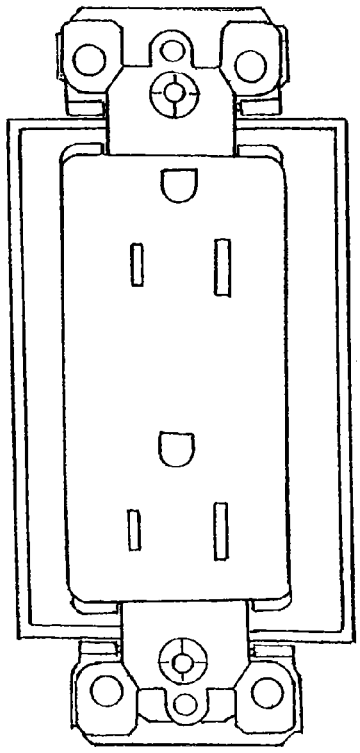
FIG. 7B Prior Art
Figure 8:
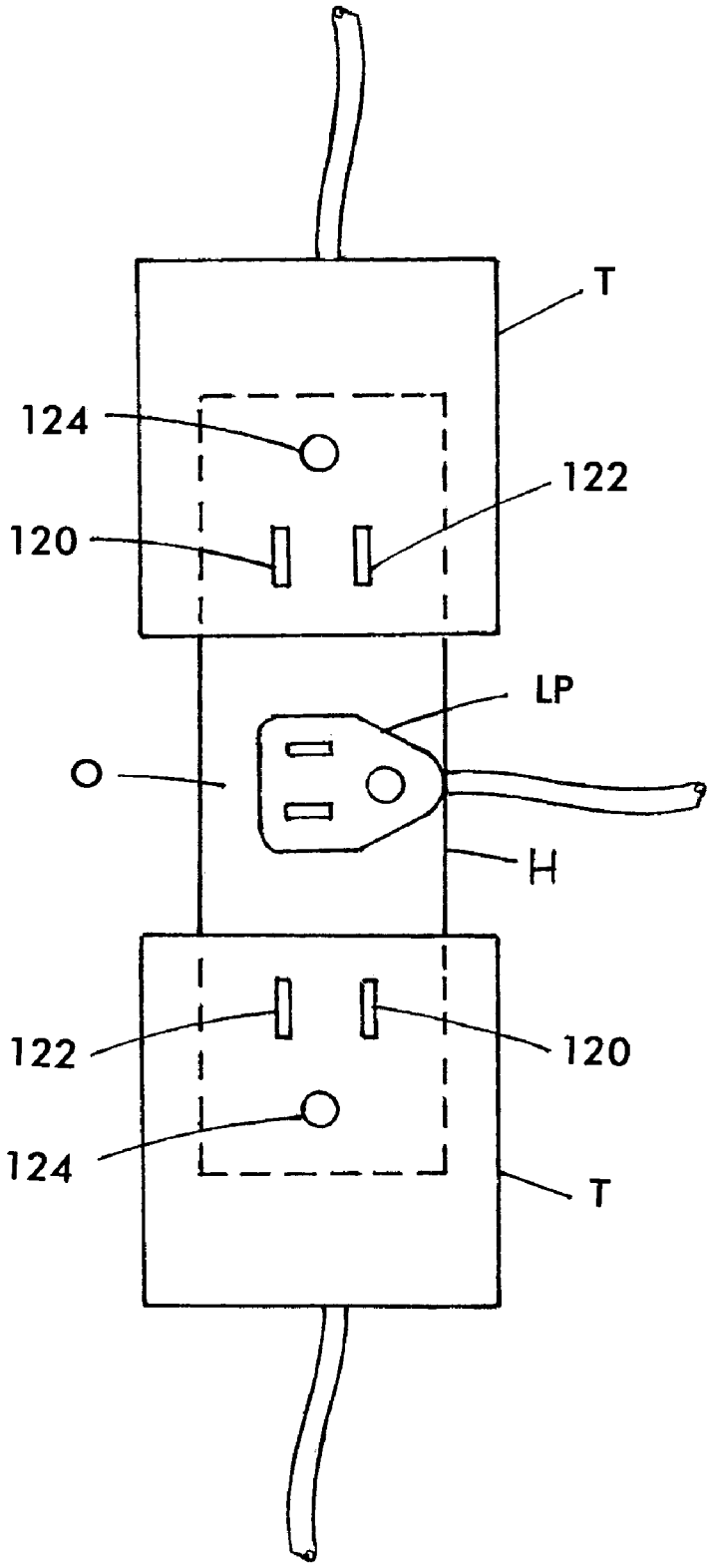

FIG. 7A shows an electrical outlet in accordance with FIG. 1 positioned in a standard single gang electrical box;

FIG. 7 B shows a conventional electrical outlet positioned in a standard single gang electrical box; and FIG. 8 illustrates two transformer/adaptors and a line plug plugged into a triplex electrical outlet in accordance with an embodiment of the present application.

DETAILED DESCRIPTION

Figure 2:
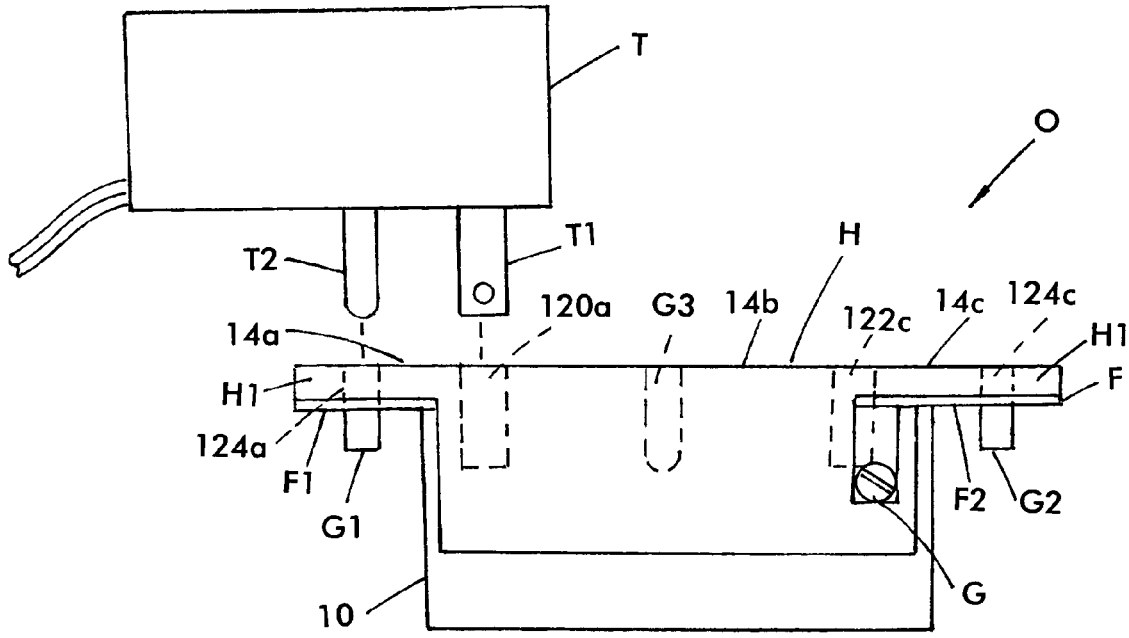
FIG. 2 illustrates a side view of the electrical outlet of FIG. 1 in an electrical wall box.

An electrical outlet O in accordance with an embodiment of the present invention is illustrated in FIG. 1. The outline of a standard single gang electrical box 10 is shown in conjunction with the electrical outlet O. Electrical outlet O comprises an insulating housing H that includes several electrical receptacles 14*a*, 14*b*, 14*c*, each of which can accommodate a plug from an electrical appliance or other electrical device. Each of the receptacles 14*a*, 14*b*, 14*c* includes a hot opening 120, a neutral opening 122 and a ground opening 124 to accommodate (see FIG. 2) a hot prong (not shown), a neutral prong $T_1$ and a ground prong $T_2$ which are provided in an electrical plug or transformer/adaptor T as shown in FIG. 2 (typically for reducing the line voltage) for electrical appliances and the like. For example, as shown, for U.S. style receptacles, the hot opening 120 and the neutral opening 122 are positioned adjacent to each other and the ground opening 124 is centered between and positioned below the hot and neutral input openings. While not specifically illustrated in FIG. 1, each of the hot input opening 120, the neutral input opening 122 and the ground input opening 124 include one or more electrical contacts, positioned therein, that establish electrical connection with the a hot prong, neutral prong $T_1$ and ground prong $T_2$, respectively, of the conventional electrical plug or transformer/adaptor T.

Specifically, the outlet O illustrated in FIG. 1 includes three receptacles (a triplex outlet), 14*a*, 14*b*, 14*c*. Each of the receptacles 14*a*, 14*b*, 14*c* has a different orientation in the outlet O. The top receptacle 14*a* is preferably positioned such that the ground opening 124 is positioned adjacent to the top edge of the outlet O and the bottom receptacle 14*c* is positioned such that the ground opening 124 is positioned adjacent to the bottom edge of the outlet O. The middle receptacle 14*b* is preferably positioned such that the ground opening 124 is positioned adjacent to one edge (left or right) of the outlet O. Thus, the middle receptacle, 14*b* is preferably positioned such that it is offset by 90° relative to the receptacles 14*a* and 14*b*. In this manner, all of the ground input openings 124 face outward and are adjacent to an edge of the outlet O.

For the triplex outlet shown, portion H1 at each end of the housing H of the outlet O may extend outside of the electrical box 10. However, all electrical wiring is preferably contained within the electrical box 10. Accordingly, the housing portion H1 at each end may extend out of the electrical box 10 over the respective top and bottom edge of the electrical box, in contrast to a standard two receptacle outlet and a special face plate for the outlet may be used to cover the electrical box. Holes S are provided to allow mounting of outlet O to the box 10 via screws S1 (see FIGS. 6A and 7A).

FIG. 2 illustrates a side view of the outlet O positioned in the electrical box 10 that shows how the portions H1 of the housing H of the outlet O extend outside of and over the walls of the electrical box 10. The outlet O preferably includes a metallic frame F, which includes means F1 and F2 for fastening the outlet to the electrical box 10, at a top and bottom of the outlet O. The frame F is preferably covered by plastic or other non-conductive material of the housing H in which the hot opening 120, the neutral opening 122 and the ground opening 124 of each of the receptacles are formed. As can be seen in FIG. 2, the ground openings 124*a* and 124*c* of the receptacles 14*a* and 14*c* are formed in the plastic housing H of the outlet at a position outside of the electrical box 10. Contacts G1 and G2, which are positioned in the ground openings 124, are physically and electrically connected to metallic frame F via portions F1 and F2 of the frame which also extend beyond the electrical box 10. In a typical embodiment, a common ground terminal G is also provided on the metallic frame F. This terminal G may be connected to a ground wire from the electrical system within the electrical box 10. Alternatively, in some electrical systems, when the electrical boxes are metal and connected by metal armor covered cables, the ground connection, as well known, is made by the mechanical connection of the frame F to the metal box 10.

Thus, while the ground openings 124*a*, 124*c* of the receptacles 14*a*, 14*c* are positioned outside of the electrical box 10, all wiring of the outlet O to the AC power lines is preferably done inside the box, including connecting the common ground G. It is also noted that the ground receptacle 124*b* of the receptacle 14*b* similarly includes an electrical contact (not shown) that is connected to the common ground G. However, this connection is provided internally in the outlet in a conventional manner well known in the art and thus is not illustrated in FIG. 2.

Terminals 16*a*, 16*b*, 16*c* are provided for connecting the outlet O to an AC electrical system and may be positioned on one or both sides of the outlet. The side view of the outlet O in of FIG. 1 provides a schematic representation of how the AC lead wires of an AC electrical system are connected to an outlet such as outlet O. Terminal 16*a* provides for a connection to ground, and corresponds to the common ground G, discussed above with reference to FIG. 2. Terminals 16*b* and 16*c* provide for a connection to a hot lead and a neutral lead of an AC power system and are internally connected to contacts in hot opening 120 and the neutral opening 122 of each of the receptacles 14*a*, 14*b*, 14*c*. While terminals 16*b* and 16*c* are illustrated on the same side of the outlet O in FIG. 1, it is noted that generally, multiple terminals for the hot lead and multiple terminals for the neutral lead are positioned on opposite sides of the outlet, such that if desired, a separate hot lead and/or neutral lead can be connected to each of the terminals to provide an independent connection to each of the receptacles, thus allowing individualized control of appliances plugged into each receptacle. If such individualized control is undesired or unnecessary, all of the terminals for hot leads 16*b* and all of the terminals for neutral leads 16*c*, respectively, are typically connected to each other such that a single hot lead and a single neutral lead can be connected to a single terminal and still be connected to each of the receptacles 14*a*, 14*b*, 14*c* of the outlet O. This connection is generally severable to provide the individual control described above.

FIG. 6A illustrates a top view of an outlet O in accordance with FIG. 1 and the standard electrical box 10 of FIG. 1. FIG. 7A is a top view of the outlet of FIG. 6A positioned and secured in the electrical box of FIG. 6A. Further, FIG. 8 illustrates that two transformers/adaptors T can be plugged into the outlet O without interference, while allowing the middle receptacle 14*b* to be used to receive a standard electrical plug LP. As shown in FIG. 7A, the triplex outlet O is mounted with screws S1, as shown, to the electrical box 10 and is shifted to one side in order that it can be fastened to the studs of receptacle mounting holes of the box 10. Since the receptacle is shifted to one side, it may be necessary to provide all wiring terminals 16*a*, 16*b*, 16*c* on one side of the outlet to allow sufficient space for connecting the wires to the terminals.

Figure 3A:
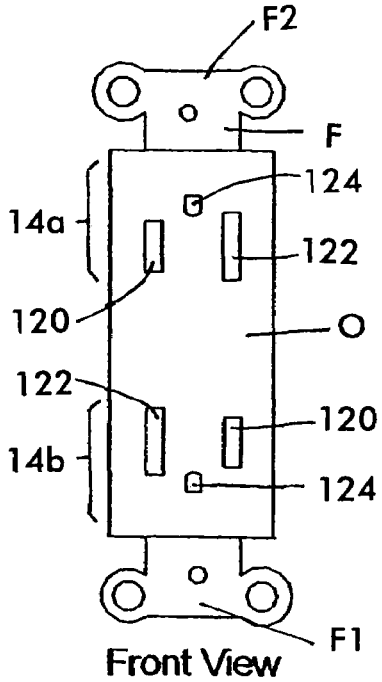
FIGS. 3A and 3B illustrate an electrical outlet in accordance with a second embodiment of the present invention.
Figure 3B:
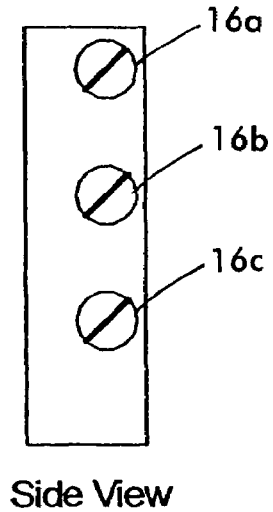

An alternative embodiment of the present invention is illustrated in FIG. 3. FIG. 3 shows an embodiment of the invention having only two receptacles (duplex receptacle) 14*a*, 14*b*, with the two receptacles being in opposite orientations that is, the upper receptacle 14*a* has the ground opening 124 positioned adjacent the top edge of the outlet O and the lower receptacle 14*b* has the ground input opening 124 positioned adjacent the bottom edge of the outlet O. Again, this allows two transformers to be plugged simultaneously into the outlet O. In this configuration, the outlet O will fit into a standard electrical box 10 and a standard face plate can be used.

Figure 4A:
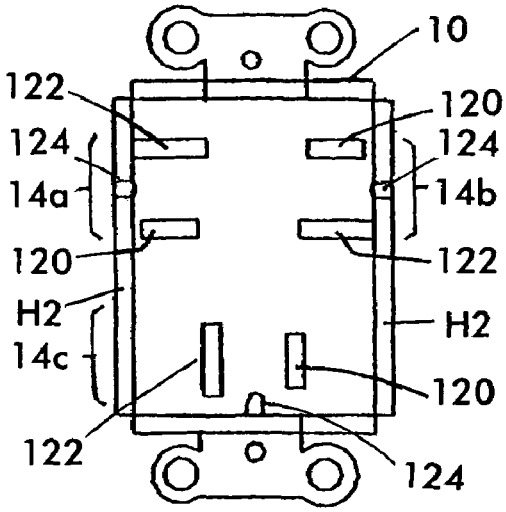
FIGS. 4A and 4B illustrate an electrical outlet in accordance with another embodiment of the present invention.
Figure 4B:
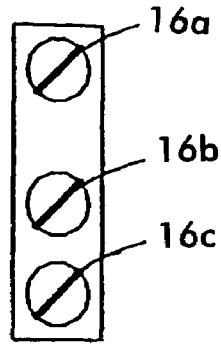

FIG. 4 shows another embodiment of the present invention in which the electrical outlet O has three receptacles, where the upper two receptacles 14*a*, 14*b* are in a line and the lower receptacle 14*c* faces downwardly. That is, the ground openings 124 of the upper two receptacle 14*a*, 14*b*, each face outwardly, adjacent the left and right edge of the outlet O, respectively, allowing multiple transformer/adaptors to be plugged in simultaneously. The ground opening 124 of the lower receptacle 14*c* is positioned adjacent the bottom edge of the outlet O. Alternatively, the outlet can be flipped, in which case the receptacle 14C is on top. In this embodiment, portions H2 of the housing of the outlet O extend beyond the electrical box 10 on both the left and right sides of the electrical box 10. The ground openings 124 of the receptacles are similarly provided in the plastic housing covering the frame F described above with respect to FIG. 2, and the metallic frame F preferably includes portions that extend beyond the sides of the electrical box 10, instead of at the top and bottom of the electrical box 10 as illustrated in FIG. 2. Similarly, contacts in the ground openings 124 are also connected to provide the electrical ground connections to the frame F in a manner similar to that described above with respect to FIG. 2

Figure 5A:
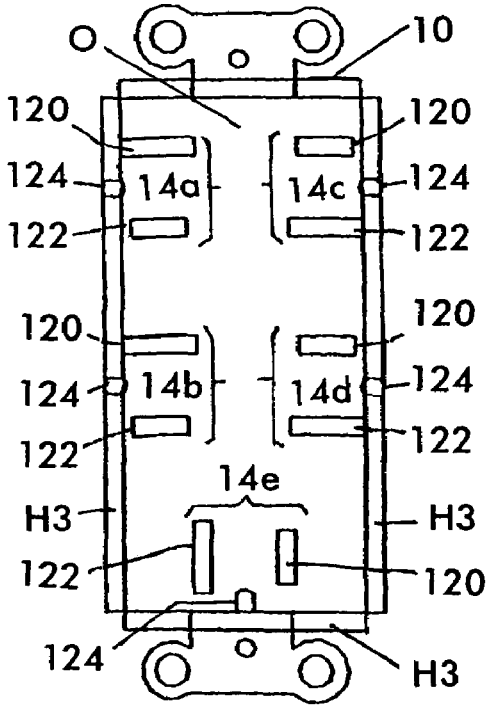
FIGS. 5A and 5B illustrate an electrical outlet in accordance with a further embodiment of the present invention.
Figure 5B:
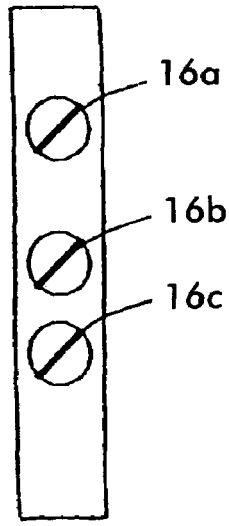

FIG. 5 shows another alternative embodiment of the present invention in which the outlet O includes five receptacles 14*a*,14*b*,14*c*,14*d*,14*e*. In this embodiment, receptacles 14*a* and 14*b* are positioned such that ground openings 124 are positioned adjacent to the left edge of the outlet O, while receptacles 14*c*, 14*d* are positioned such that the ground openings 124 thereof are adjacent the right edge of the outlet O. Receptacle 14*e* is positioned such that the ground opening 124 thereof is positioned adjacent the bottom edge of the outlet O. Of course, the outlet can be flipped upside down. Thus, multiple transformers/adaptors T can be plugged into the outlet O without interference therebetween. In this embodiment, the portions H3 of the housing of the outlet O that extends beyond the electrical box 10 includes three sections which extend on both the left and right sides and the bottom of the electrical box 10. The ground openings 124 of the receptacles 14*a*, 14*b*, 14*c*, 14*d* and 14*e* are similarly provided in the plastic housing described above with respect to FIG. 2, and the metallic frame F preferably includes portions that extend beyond the sides of the electrical box 10 to provide for the ground contacts. The contacts in the ground openings 124 are connected to the frame F in a manner similar to that described above with respect to FIG. 2.

Although this application shows the various embodiments of the invention in a vertical orientation, the outlets can be positioned in any desired orientation.

Although the present invention has been described in relation to particular embodiments thereof, many other variations and modifications and other uses will become apparent to those skilled in the art. Therefore the present invention should be limited not by the specific disclosure herein, but only by the appended claims.

What is claimed is:

1. An electrical outlet for mounting in an electrical box comprising:

a plurality of receptacles in a housing for receiving a plurality of electrical plugs, wherein each receptacle includes two electrical line openings and a ground opening, wherein the plurality of receptacles are positioned such that the ground opening of each of the plurality of receptacles is positioned outwardly with respect to the electrical line openings, wherein the plurality of receptacles includes a first receptacle, a second receptacle and a third receptacle, and wherein the ground opening of the first receptacle is positioned adjacent a left edge of the electrical outlet, the ground opening of the second receptacle is positioned adjacent a right edge of the electrical outlet and the ground opening of the third receptacle is positioned adjacent a bottom or top edge of the electrical outlet.

2. The electrical outlet of claim 1, wherein the positioning of the receptacles allows at least two transformer/adaptors to be plugged into the outlet simultaneously without interference.

3. The electrical outlet of claim 1, wherein at least one of the ground openings is provided in an area outside the electrical box.

4. The electrical outlet of claim 3, wherein the at least one ground opening provided in an area outside of the electrical box has an electrical contact in electrically conductive relationship with a frame of the outlet connectable to an electrical system ground.

5. An electrical outlet for mounting in an electrical box comprising:

a plurality of receptacles in a housing for receiving a plurality of electrical plugs, wherein each receptacle includes two electrical line openings and a ground opening, wherein the plurality of receptacles are positioned such that the ground opening of each of the plurality of receptacles is positioned outwardly with respect to the electrical line openings, wherein the plurality of receptacles includes a first receptacle, a second receptacle and a third receptacle positioned in a single vertical line; and wherein at least one of the ground openings is provided in an area outside the electrical box.

6. The electrical outlet of claim 5, wherein the ground opening of the first receptacle is positioned adjacent a top edge of the electrical outlet, the ground opening of the second receptacle is positioned adjacent one of the left and right edges of the electrical outlet and the ground opening of the third receptacle is positioned adjacent a bottom edge of the electrical outlet.

7. The electrical outlet of claim 5, further comprising:

a ground terminal that is electrically connectable to the electrical system ground, wherein the ground opening of each of the plurality of receptacles has a contact that is connected to the ground terminal.

8. The electrical outlet of claim 5, further comprising:

a first lead terminal electrically connected to a contact of a first of the electrical line openings of each of the plurality of receptacles; and a second lead terminal electrically connected to a contact of a second of the electrical line openings of each of the plurality of receptacles; wherein lead wires from an electrical system are connectable to the first and second lead terminals.

9. The electrical outlet of claim 5, wherein the positioning of the receptacles allows at least two transformer/adaptors to be plugged into the outlet simultaneously without interference.

10. The electrical outlet of claim 5, wherein the at least one ground opening provided in an area outside of the electrical box has an electrical contact in electrically conductive relationship with a frame of the outlet connectable to an electrical system ground.

11. An electrical outlet for mounting in an electrical box comprising:

a housing structured for mounting in the electrical box;

a plurality of receptacles in the housing for receiving a plurality of electrical plugs, wherein each receptacle includes two electrical line openings and a ground opening, wherein the plurality of receptacles are positioned such that the ground opening of each of the plurality of receptacles is positioned outwardly with respect to the electrical line openings, wherein the plurality of receptacles includes a first receptacle, a second receptacle, a third receptacle, a fourth receptacle and a fifth receptacle; and wherein at least one of the ground openings is provided in an area outside the electrical box.

12. The electrical outlet of claim 11, wherein ground openings of the first receptacle and the second receptacle are positioned adjacent a left edge of the electrical outlet, the ground openings of the third receptacle and the fourth receptacle are positioned adjacent a right edge of the electrical outlet and the ground input opening of the fifth receptacle is positioned adjacent a bottom edge of the electrical outlet.

13. The electrical outlet of claim 11, wherein the at least one ground opening provided in an area outside of the electrical box has an electrical contact in electrically conductive relationship with a frame of the outlet connectable to an electrical system ground.

* * * * *